US005601106A

United States Patent [19]

Guasto

[11] Patent Number: 5,601,106

[45] Date of Patent: Feb. 11, 1997

[54] MULTI-SCREEN SOLAR BARRIER

[76] Inventor: John J. Guasto, 330 SE. 20th Ave., Apt. 214, Deerfield Beach, Fla. 33441

[21] Appl. No.: 389,251

[22] Filed: Feb. 16, 1995

[51] Int. Cl.[6] ..... E04H 15/42

[52] U.S. Cl. ..... 135/156; 135/119; 135/900; 160/23.1

[58] Field of Search ..... 135/139, 115, 135/119, 156, 143, 900; 160/23.1

[56] References Cited

U.S. PATENT DOCUMENTS

| | | | |
|---|---|---|---|
| D. 265,862 | 8/1982 | Caldwell | D3/5 |
| 2,886,047 | 5/1959 | Healy | 135/139 X |
| 2,928,405 | 3/1960 | Lawson | 135/119 X |
| 4,295,481 | 11/1981 | Gee | 135/5 R |
| 4,610,292 | 9/1986 | Hausmann et al. | 160/23.1 X |
| 4,758,042 | 7/1988 | Lin | 296/97.7 |
| 4,821,353 | 4/1989 | Neri | 5/418 |
| 4,823,822 | 4/1989 | Maya | 135/87 |
| 4,958,652 | 11/1990 | Maya | 135/87 |
| 5,000,210 | 3/1991 | Worthington, Jr. | 135/90 |
| 5,066,082 | 11/1991 | Longstaff | 359/361 |
| 5,088,514 | 2/1992 | House et al. | 135/107 |
| 5,154,473 | 10/1992 | Joranco | 297/184 |
| 5,261,435 | 11/1993 | Stanley et al. | 135/90 |
| 5,271,446 | 12/1993 | Hwang | 160/23.1 |
| 5,275,018 | 1/1994 | Lin et al. | 62/457.7 |
| 5,303,726 | 4/1994 | Merrill | 135/119 X |
| 5,320,405 | 6/1994 | Foster et al. | 297/184.17 |
| 5,415,194 | 5/1995 | Kaye | 135/119 X |
| 5,437,298 | 8/1995 | Lin | 135/115 X |

*Primary Examiner*—Lanna Mai
*Attorney, Agent, or Firm*—John C. Smith

[57] ABSTRACT

A retractable dual solar screen which is supported by adjustable poles above the tanner or sun bather and selectively screens out harmful UV radiation and/or provides shade without UV screening. The first screen filters UV radiation and the second screen filters a broad spectrum of sunlight. In addition, an adjustable mechanism allows the planes of the screens to direct the flow of air currents such that a wind acceleration effect is achieved which causes accelerated airflow over the user, thereby cooling the body temperature of the user. The height of the device is adjustable.

10 Claims, 11 Drawing Sheets

MULTI-SCREEN SOLAR BARRIER

BACKGROUND OF THE INVENTION

1. Technical Field

The present invention relates to solar protection devices. In particular, foldable compact devices which provide dual levels of sun screening through the selectable combination of shade screens and/or Ultra-violet (UV) screens to reduce exposure to sunlight while engaging in outdoor activities, such as tanning, sun bathing, picnicking, etc.

2. Background Art

Historically, beach goers have subjected themselves to excessive sunlight in order to enjoy the pleasures of outdoor activities, such as going to the beach. The damaging effects of the sun on skin were typically unavoidable unless the beach goer left the beach earlier than desired. As the seriousness of the damage to skin caused by sunlight became better known, attempts have been made to allow individuals to enjoy outdoor activities with reduced exposure to harmful sunlight.

One approach to this problem is the use of chemical sun block lotions which reduce the damaging effects of sunlight. These products are designed to provide various levels of protection to suit individual needs. However, sun block lotions have inherent drawbacks due to their nature. For example, these products are consumables which require periodic replenishment. As a result, these products result in a constant expenditure of funds. Also, even if these products are affordable for a given user, not all individuals are able to use sun block due to allergic reactions, etc. Further, the prolonged and repeated exposure of these chemicals to the skin may facilitate or act as a catalyst for other more severe health problems such as cancer.

An alternative approach has been the development of mechanical sun screens which avoid the problems associated with chemical sun blocks. Mechanical screens typically fall into two categories: solid screens which block all direct light, and translucent screens which partially block direct light. The translucent variety is further divided into screens which block UV (ultra violet) light and screens which block all or most of the frequency spectrum. Physical configurations of these devices tend to be umbrella type structures or panels.

One drawback to these devices is their inability to vary the amount or type of screening which is accomplished. For example, a user may only desire to limit UV radiation on some days, and on other days desire to merely provide shade for cooling while allowing exposure to sunlight for tanning purposes. On occasion, a user may wish to reduce both sunlight and remove as much UV radiation as possible to extend the amount of time which can be comfortably and safely spent outdoors. The single mode devices of the prior art are incapable of providing this type of flexibility since they only use one type of screening material.

Another disadvantage common to the foregoing devices is the inability to conveniently extend the size of the area shaded and to alter the effective volume of area covered under the shade. The number of users who can be accommodated by prior art devices is limited by the unexpandable nature of those devices. It would be desirable to provide a user with an expandable device which would allow the same screen to be used for one or more users as the situation demands. Further, it would be advantageous to have a device which could be joined with other devices to extend the protected area.

In addition, these devices are designed for the single purpose of screening sunlight. Increasing the perceived cooling effect through the use of natural wind would also be desirable for a user while under the screen. The prior art has failed to provide any mechanism to take advantage of the natural airflow which can be used to enhance the comfort of the user.

Prior art devices which are capable of providing sufficient shading area are typically bulky and difficult to transport and store. It would be desirable to have a shade device which can cover a large area, yet be quickly and easily adjusted and disassembled into a small area for transportation or storage.

The prior art has failed to provide an inexpensive method of preventing solar damage to the skin which avoids the expense and other problems associated with exposure of the skin to chemicals, which provides flexibility in terms of the components of sunlight that are screened, which provides flexibility in the area and volume of space that are shaded, and which also enhances cooling by taking advantage of wind to accelerate and redirect natural airflows.

SUMMARY OF THE INVENTION

The present invention solves the foregoing problems by providing a dual retractable screen solar barriers which rest on adjustable poles above the sun bather and selectively screen out significant amounts of harmful UV radiation and/or provide shade without UV screening. The first screen filters UV radiation and the second screen filters a broad spectrum of sunlight. In addition, an adjustable mechanism which allows the planes of the screens to direct the flow of air currents such that a wind acceleration effect is achieved which causes accelerated airflow over the user, thereby cooling the body temperature of the user.

DESCRIPTION OF THE PREFERRED EMBODIMENT

Figure 1A:
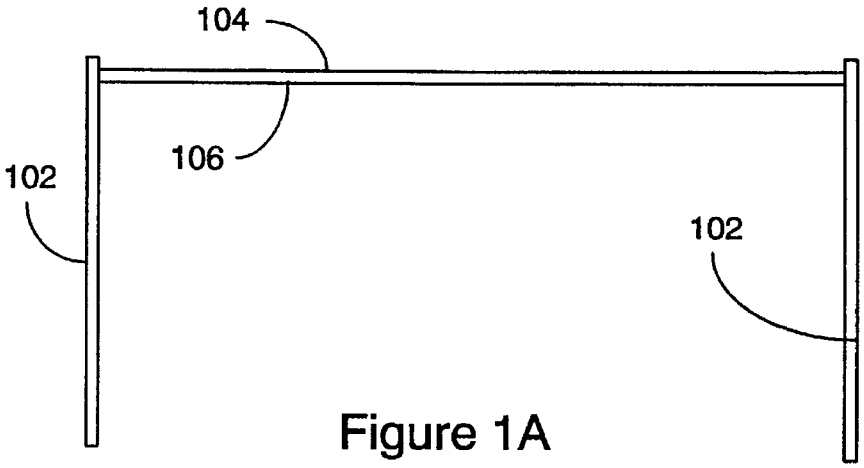
FIG. 1A is a diagram showing a side view of the solar barrier on the mounting poles.

FIG. 1A is a side view showing poles 102 which provide support sections for solar screens 104 and 106. In the preferred embodiment, solar screen 104 provides a barrier for UV radiation and solar screen 106 provides a general shade barrier for a wide frequency range of solar radiation. Those skilled in the art will recognize that solar screens 104, 106 can be interchanged at the users convenience. Likewise, a principle advantage of the invention is that it allows a user to selectively control the type of solar radiation the user will be exposed to. For example, shade screen 106 can be opened (i.e., extended over the user) and UV screen 104 retracted or removed to keep the user cooler while allowing UV radiation to penetrate for skin tanning purposes. Of course, the opposite can be effected by opening the UV screen 104 to prevent tanning while closing the shade screen 106 to increase warmth in cooler weather. Finally, both screens 104, 106 can be opened to minimize tanning and heat.

Poles 102 have a height sufficient to allow a user to comfortably occupy the space under solar screens 104, 106. In the preferred embodiment, the height is adjustable from one and a half up to eight feet high. By telescoping the poles 102, the device can be adjusted for user comfort as well as being more easily transported or stored when not in use. However, the height is not a critical feature as long as it provides a comfortable amount or space for the user. While poles 102 can be constructed from any number of materials, the preferred embodiment uses recyclable plastics.

Figure 1B:
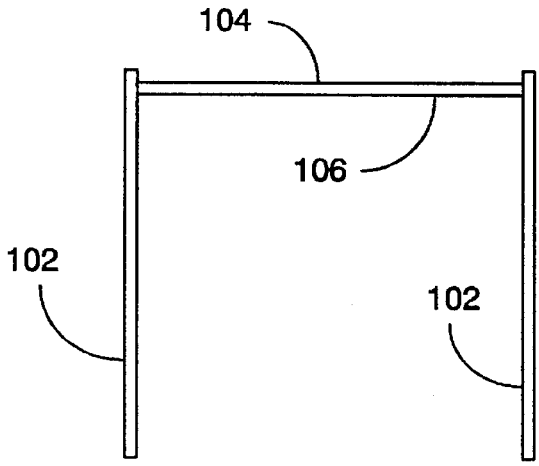
FIG. 1B is a diagram showing an end view of the solar barrier on the mounting poles.

FIG. 1B is an end view of the device shown in FIG. 1A.

Figure 1C:
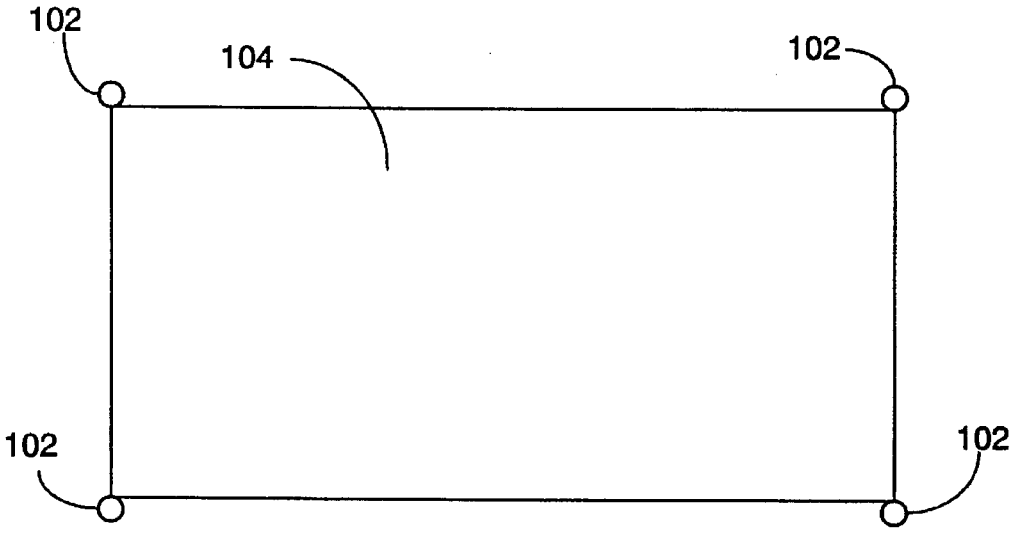
FIG. 1C is a diagram showing a top view of the solar barrier on the mounting poles.

FIG. 1C is a top view of the device of FIGS. 1A and 1B. In the preferred embodiment, the device solar screen 104 is four feet wide by eight feet long. However, the size can vary to suit individual user requirements. Further, since the screens 104, 106 detach from poles 102, a variety of screen 104, 106 sizes can be interchanged with the same poles 102. As discussed in more detail below, two or more units can be secured together to provide a larger total area for group activities or for covering things such as infant playpens to allow small children to comfortably and safely enjoy the outdoors.

In the preferred embodiment, the screens 104, 106 are made from polyester films having a thickness of 1–4 mils. The particular thickness is not important so long as the material used has suitable strength and radiation insulation characteristics. A variety of commercially available film materials can be used for the solar barrier. For example, 3M corporation in St. Paul, Minn. manufactures several types of films suitable for use (for example film part numbers RE70NEARL, RE35NEARL, and RE20NEARL). Typical UV insulation for commercially available films exceed 90 percent and can reach insulation levels of 99 percent. Solar heat reduction in commercial films has a broader range. For example, the commercial UV resistant films discussed above vary between 98 and 99 percent UV reduction, while their solar heat reduction varies between 19 and 59 percent, respectively. Of course, tinted films designed for shading do not have to be manufactured with any UV insulation. The term UV insulation, as used herein, refers to any form of UV blockage, including absorption, reflection, etc.

Commercially available screen material of the type described above is also available with a pre-applied adhesive which is held in place during shipping by a flexible transparent polyester film backing. It has been found that this backing provides additional strength to the solar screen 106 and the UV screen 104. Therefore, while not required for satisfactory operation, the preferred embodiment uses screens 104, 106 without removing the flexible transparent polyester film backing which results in a sturdier screen 104, 106.

Figure 2:
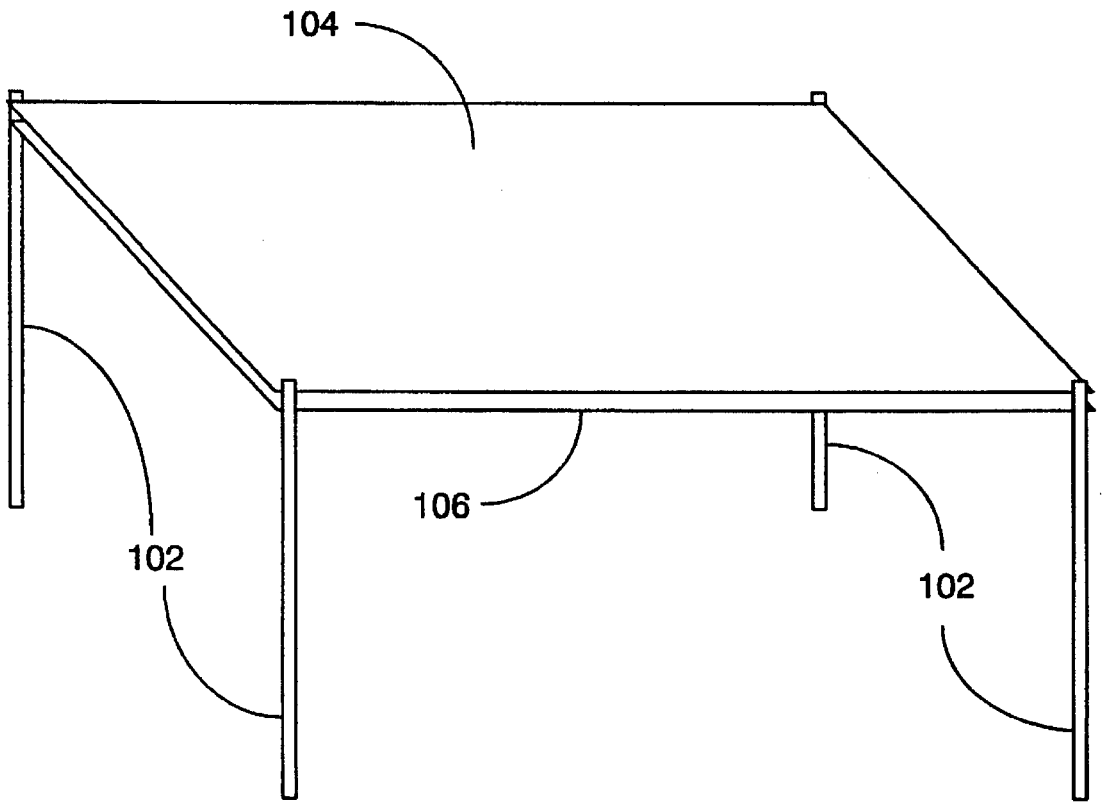
FIG. 2 is a diagram showing a perspective view of the solar barrier on the mounting poles.

In FIG. 2, a perspective view of the device of FIGS. 1A through 1C is shown. As can be seen, UV screen 104 and shade screen 106 occupy parallel planes in this configuration. As will be discussed more fully below, the screens can also be individually adjusted to allow the plane of the screens 104, 106 to slope from one end to another.

Figure 3:
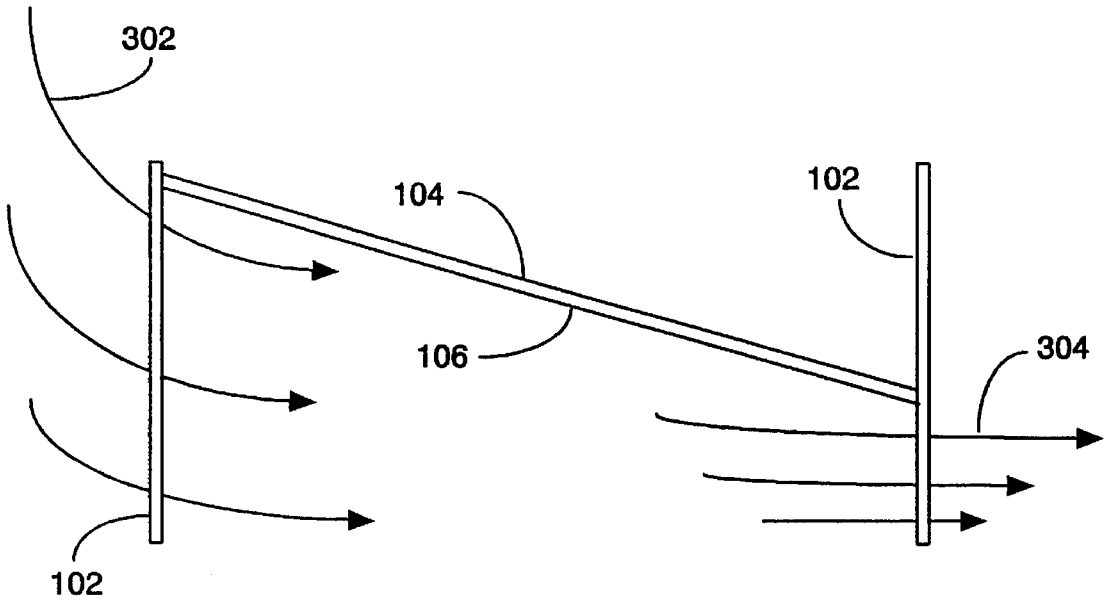
FIG. 3 is a diagram showing a preferred embodiment of a side view of the solar barrier on the mounting poles. In this view, the barrier is adjustably lowered at the end opposite the direction of the wind to accelerate the speed of natural outdoor airflow.

In the preferred embodiment, the solar screens 104, 106 can be attached to poles 102 at a variety of locations. FIG. 3 shows solar screens 104, 106 attached at one end at a lower position on poles 102. If the higher end of solar screen 104 faces the direction of the wind 302, then the air will be compressed by solar screen 104 such that it emerges at the lower end as accelerated wind 304 due to the creation of a venturi effect by the solar screens 104, 106. This venturi effect increases the rate of airflow over the users body which in turn enhances the cooling effect of the wind. As a result, the cooling provided by the insulating effects of screens 104, 106 is further enhanced by focussing and accelerating the wind toward the user.

Figure 4A:
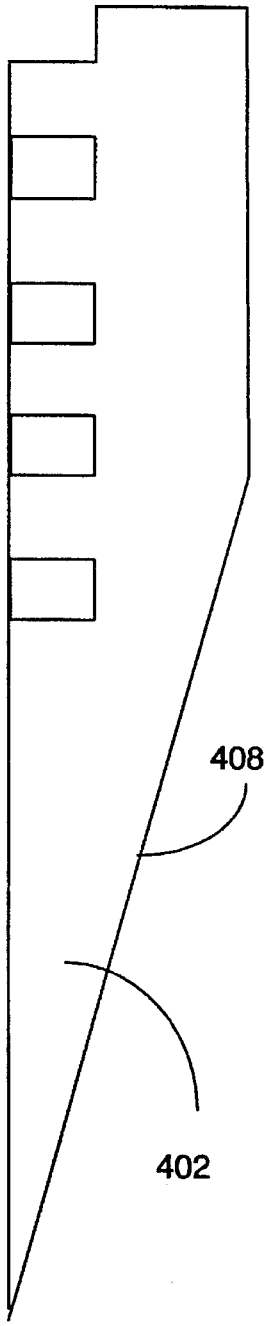
FIGS. 4A–C is a diagram showing the structure of a preferred embodiment of the mounting poles including an outer sleeve and an inner telescoping rod inside the sleeve and a securing dowel.
Figure 4B:
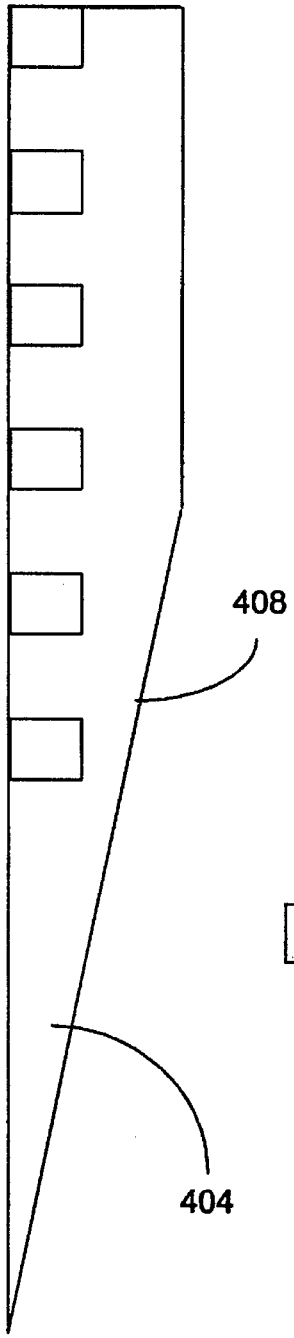
Figure 4C:
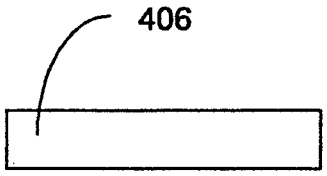

FIGS. 4A–C shows a preferred embodiment of the invention which uses rods 404 mounted inside of sleeves 402 to form poles 102. In this embodiment, dowels 406 are used to adjust length of the poles. Dowels can be integrated with screens 104, 106 (not shown) to attach the poles to solar barrier. Sleeves 402 and rods 404 have cut offs 408 at the lower end to facilitate embedding poles 102 into the ground or into sand. The advantage of having a series of apertures in the side of the poles 102 is that in addition to allowing rod 404 to be telescoped within sleeve 402 with dowel 406, the apertures reduce the overall weight of the device without appreciably reducing its strength. Of course, it is also possible to provide single piece poles 102 which do not have any telescoping ability. This would provide for ease of construction, but would not allow the device to be compacted into a convenient size for transport or storage.

Figure 5A:
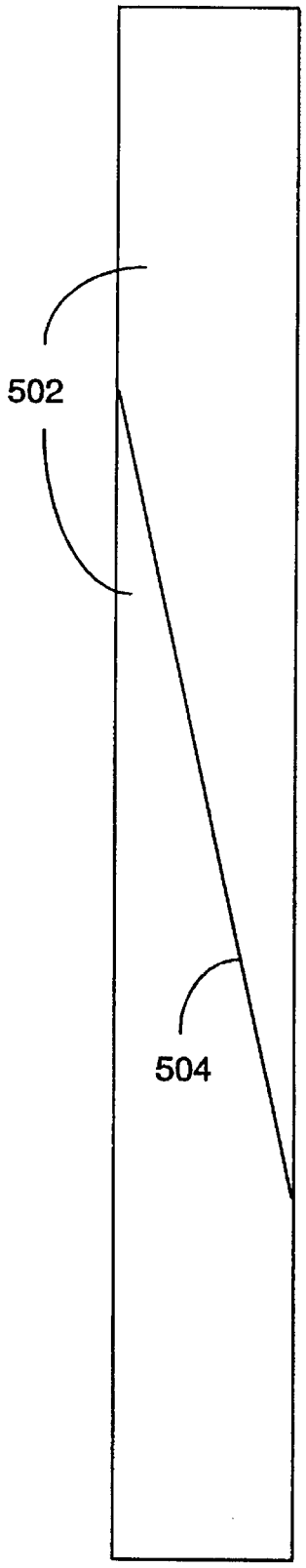
FIGS. 5A–B is a diagram illustrating a method of manufacturing the outer sleeve of FIG. 4 with a minimal use of materials.
Figure 5B:
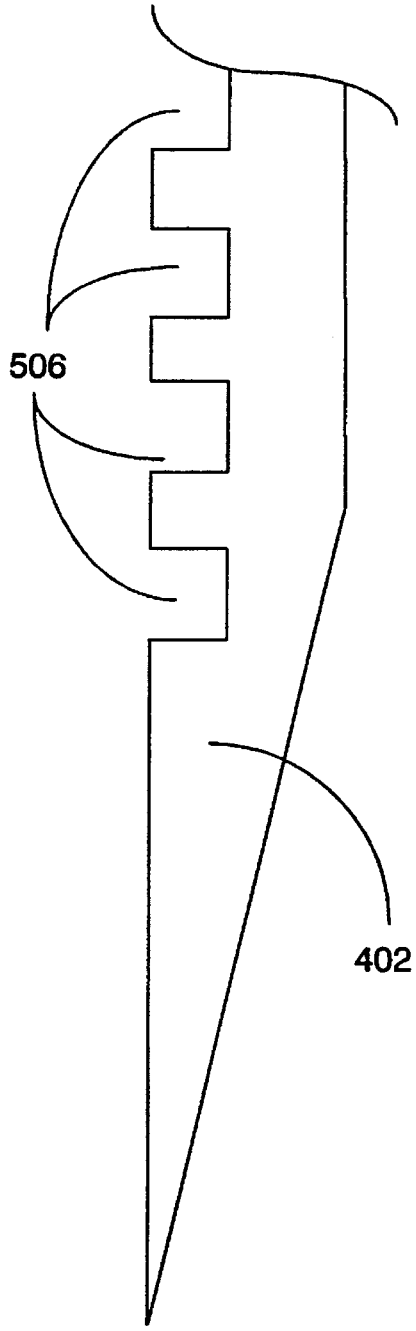

In FIGS. 5A–B, a method of manufacturing the sleeves 402 and rods 406 which comprise poles 102 is shown which minimizes material usage. Tube 502 is cut into two sections along line 504. Each resulting portion of tube 502 becomes a sleeve 402. Apertures 506 are then cut into sleeve 402 to allow insertion of either dowels 406 or insertion of a dowel integrated with screens 104, 106. The identical process can be used to manufacture rods 404.

Figure 6:
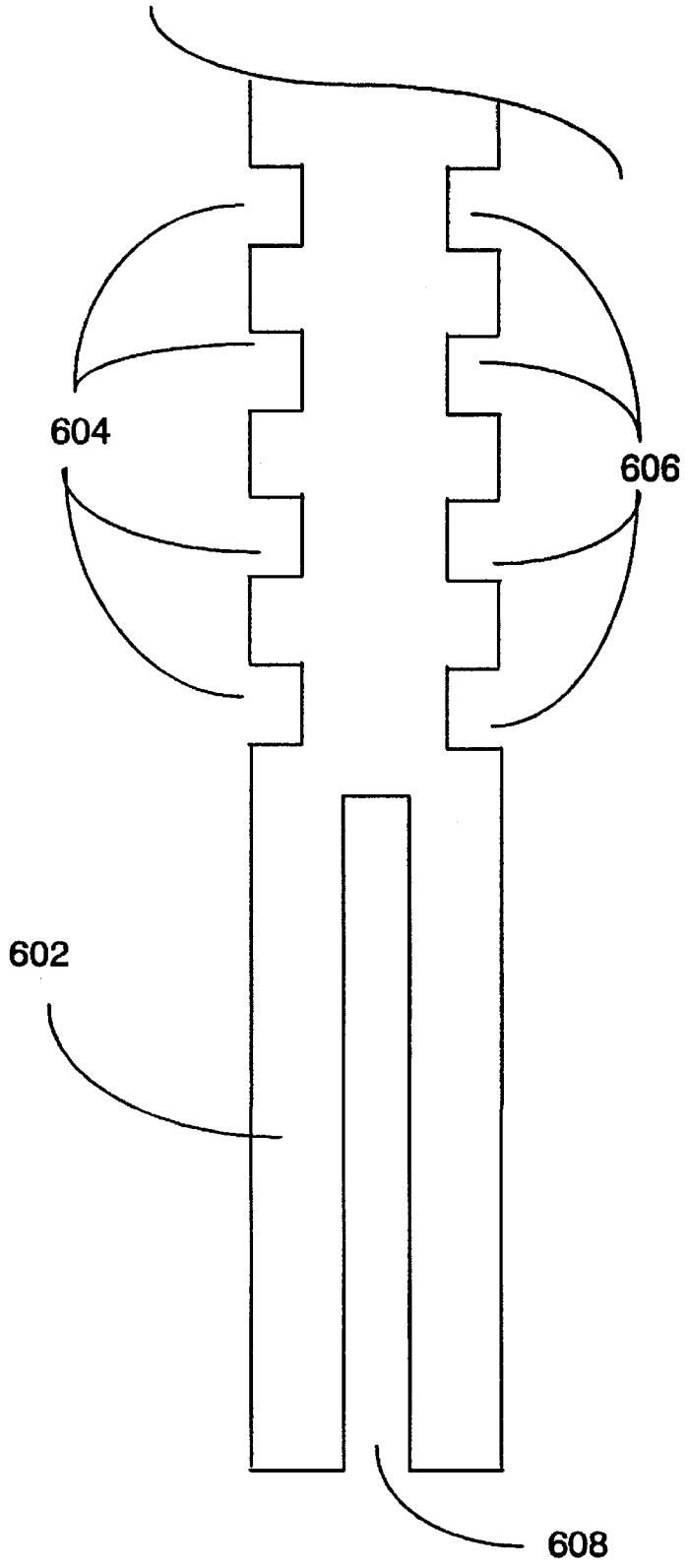
FIG. 6 is a diagram showing the structure of an alternative embodiment of the mounting poles.

FIG. 6 shows an alternative embodiment of structuring the poles 102. In this embodiment, the sleeve 602 has an alternatively shaped aperture 608 at its base. Likewise, aperture 604 and 606 are provided on opposing sides of the sleeve to both reduce weight and to allow dowels 406 and screens 104, 106 with integral dowels to be used independently.

Figure 7A:
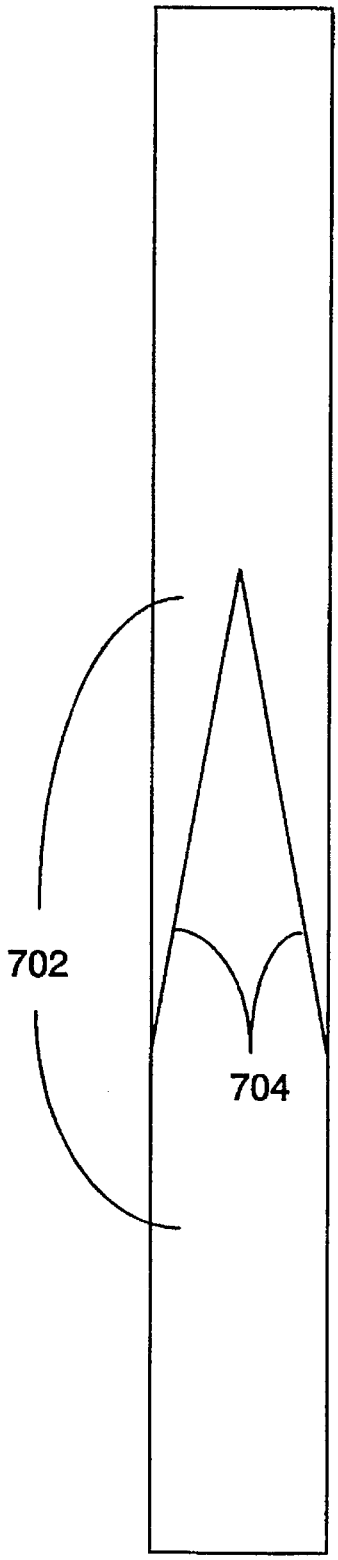
FIGS. 7A–B is another diagram showing the structure of an alternative embodiment of the mounting poles.
Figure 7B:
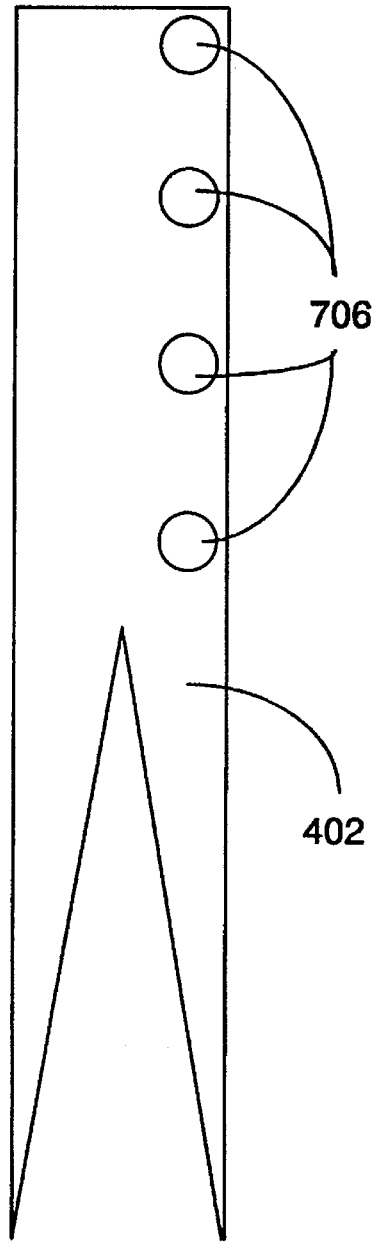

In FIGS. 7A–B, an alternative method of manufacturing the sleeves 402 and rods 406 which comprise poles 102 is shown which minimizes material usage. Tube 702 is cut into two sections along line 704. Each resulting portion of tube 702 becomes a sleeve 402. Apertures 706 are then cut into sleeve 402 to allow insertion of either dowels 406 or insertion of a dowel integrated with screens 104, 106. The identical process can be used to manufacture rods 404.

Figure 8:
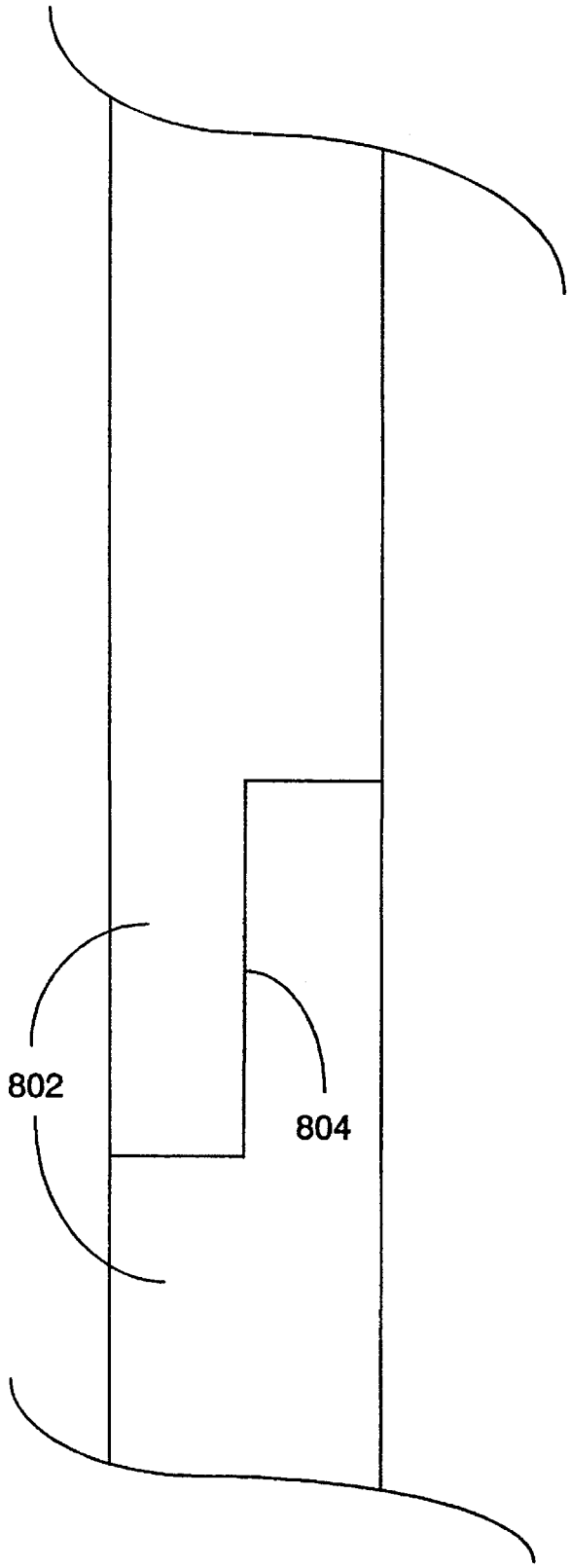
FIG. 8 is a diagram showing the structure of another alternative embodiment of the mounting poles and a method of manufacturing with a minimal use of materials.

In FIG. 8, an alternative method of manufacturing the sleeves 402 and rods 406 which comprise poles 102 is shown which minimizes material usage. Tube 802 is cut into two sections along line 804. Each resulting portion of tube 802 becomes a sleeve 402. Apertures (not shown) are then cut into sleeve 402 in the same manner as was done in the foregoing embodiments.

Figure 9:
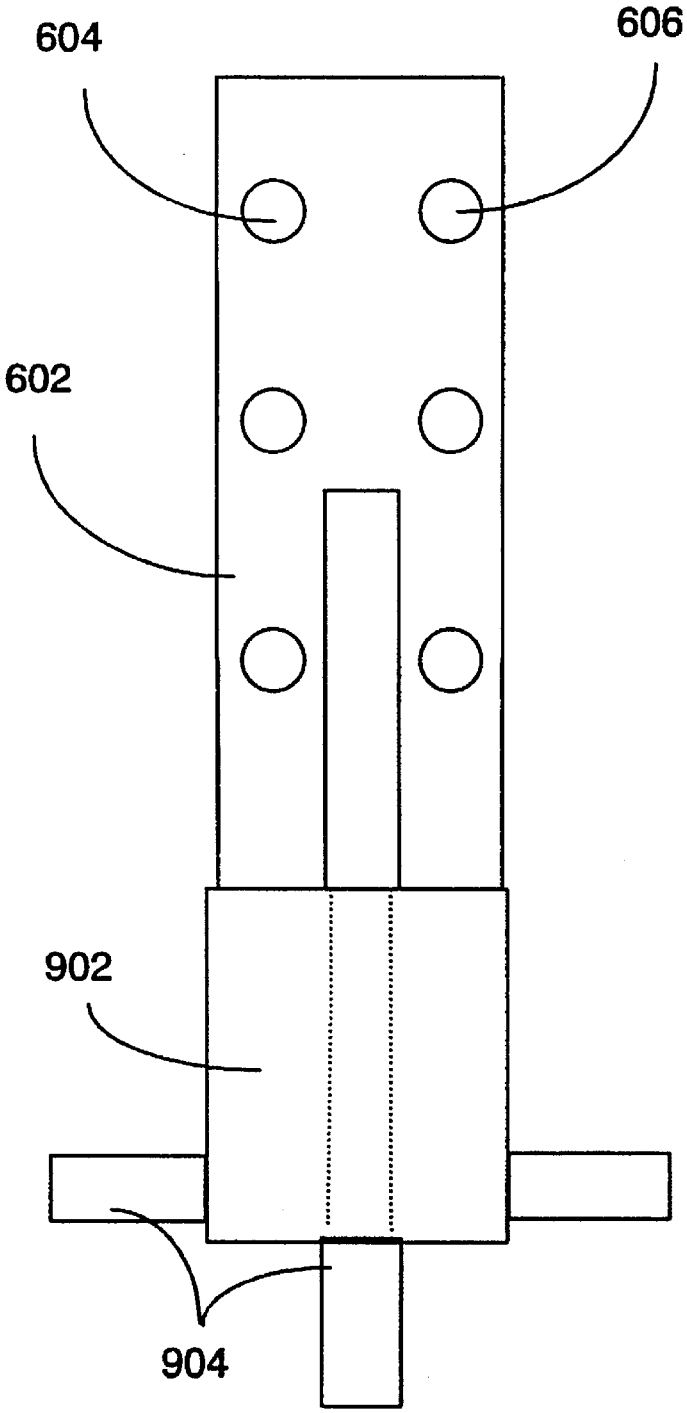
FIG. 9 is a diagram showing the mounting poles held by an optional stand.

In FIG. 9, an optional stand 902 is illustrated. Stand 902 is stabilized by support bars 904. Sleeve 602 is inserted into stand 902 when the particular ground surface makes insertion into the ground difficult. Stand 902 can also be weighted to provide additional stability.

Figure 10A:
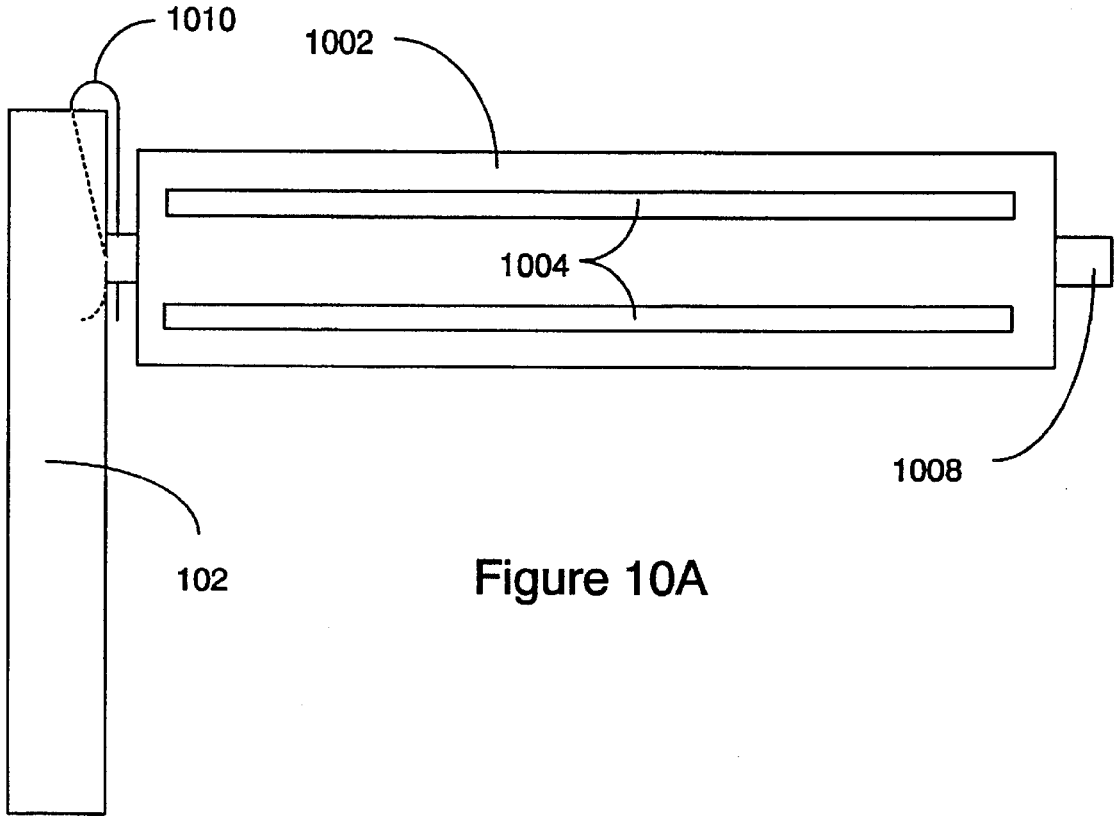
FIG. 10A is a front view showing a screen retractor assembly having separate spring loaded screen retractors for the UV screen and the solar heat screen.

FIG. 10A illustrates a front view of a screen retractor assembly 1002 which holds both the UV screen 104 and shade screen 106. Screen retractor assembly 1002 has apertures 1004 to allow passage of screens 104, 106. Integral dowels 1008 are located on either end of screen retractor assembly 1002 to permit attachment to poles 102. In addition, pole 102 is shown held to dowel 1008 by pin 1010. The advantage of pin 1010 is that it ensures that screens 104, 106 will not inadvertently fall out of pole 102. Of course, any suitable alternative securing means can be used.

Figure 10B:
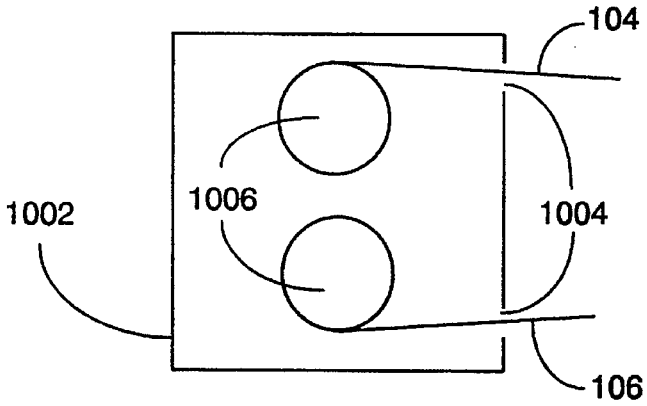
FIG. 10B is a side cutaway view showing a screen retractor assembly having separate spring loaded screen retractors for the UV screen and the solar heat screen.

FIG. 10B is a side cutaway view of screen retractor assembly 1002. This view illustrates screens 104, 106 sliding through apertures 1004. Screens 104, 106 are attached to spring loaded rollers 1006. Spring loaded rollers 1006 are similar in structure to conventional window shade rollers, well known in the art. Each screen 104 or 106 is individually controllable and may be retracted or extended independent of one another. An advantage of the retractable nature of the screens 104, 106 is that they allow the user to adjust the size of the protected area to suit a particular area. Those skilled in the art will recognize that spring loaded rollers do not have to be integrated into screen retractor assembly 1002, and can be implemented as separate units. However, screen retractor assembly 1002 permits more convenient handling and assembly.

Figure 11:
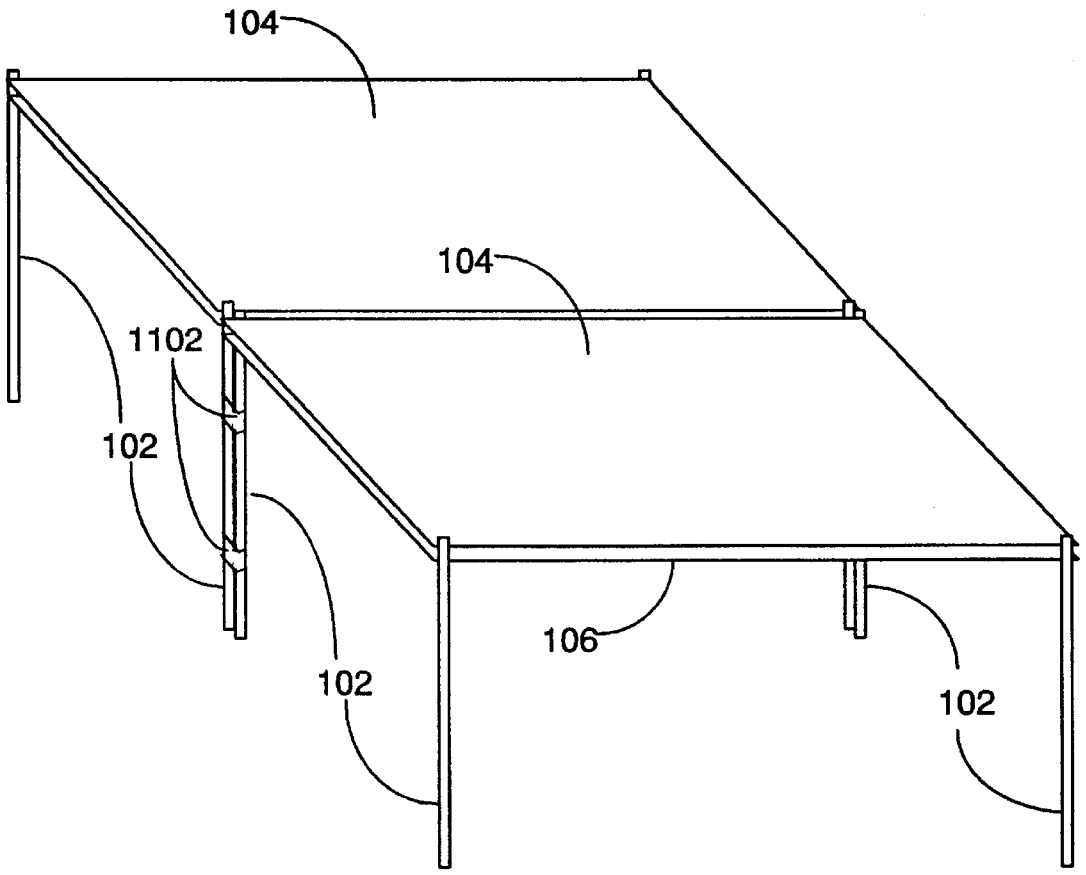
FIG. 11 is a diagram showing a perspective view of two solar barriers on the mounting poles which are coupled together.

FIG. 11 illustrates the device of FIG. 2 coupled together with a like device to enlarge the total area for which protection is provided. For example, two multi-screen solar barriers, each having a covered area of four feet by eight feet, provides a total covered area of eight feet by eight feet when coupled. A variety of coupling mechanisms can be used to hold poles 102 together. For example, clamps can attach the poles at the top. Pins (not shown) can be used in conjunction with the apertures in the sides of poles 102, etc. Hook and loop material, as shown by strips 1102, can also be used. In the preferred embodiment, the coupling mechanism is provided a single pole 102 with apertures in both sides, as illustrated in FIGS. 6 and 9, is used to provide support for both screen assemblies.

An important advantage of the multi-screen solar barrier is the compactness of the device when it is disassembled for transport or storage. This is a result of the telescoping legs and the ability to retract the screens 104, 106 into the screen retractor assembly 1002. A device which normally provides a four by eight foot shaded area can be collapsed and stored in a container (for example, a canvas carrying bag) which is 14 to 18 inches in circumference and 49 inches long. As a result, it can be easily stored, or left in the trunk of a vehicle for convenience.

While the invention has been described with respect to a preferred embodiment thereof, it will be understood by those skilled in the art that various changes in detail my be made therein without departing from the spirit, scope, and teaching of the invention. For example, the shape of the cuts is to form the lower edge of the poles 102 can vary, materials used to construct the poles can be any suitable material, such as recyclable materials, plastics, PVC, metal, wood, etc. Relative insulating strengths of the screens can vary, etc. Accordingly, the invention herein disclosed is to be limited only as specified in the following claims.

I claim:

1. A portable multi-screen sunscreen, comprising:

at least one first support section, the first support section having an upper portion for attaching at least one shade screen and one UV screen, and a lower end having means to removably embed the first support section in ground;

at least one second support section, the second support section having an upper portion for attaching at least one shade screen and one UV screen, and a lower end having means to removably embed the second support section in ground;

a shade screen, the shade screen attached in an open position at a first end to the upper portion of the first support section and attached at a second end to the upper portion of the second support section such that sunlight is substantially blocked by the shade screen when it is in the open position;

a UV screen, the UV screen attached in an open position at a first end to the upper portion of the first support section and attached at a second end to the upper portion of the second support section such that the UV portion of the sunlight is substantially blocked by the UV screen when it is in the open position;

the shade screen and the UV screen each having separate attachment means such that the shade screen or the UV screen can be independently detached from at least the first or the second support sections such that they can be retracted from the open to the closed position;

a shade screen retractor means attached to a first end of the shade screen, the shade screen retractor means having a first spring loaded roller means, the first spring loaded roller means attached to the shade screen such that when the shade screen is released from the open position, the first spring loaded roller means retracts the shade screen to a closed position;

a UV screen retractor means attached to a first end of the UV screen, the UV screen retractor means having a second spring loaded roller means, the second spring loaded roller means attached to the UV screen such that when the UV screen is released from the open position, the second spring means retracts the UV screen to a closed position;

the shade screen retractor means and the UV screen retractor means are enclosed in a single housing assembly, the housing assembly having means to attach to the first or second support sections such that the shade screen can be selectably mounted above the UV screen or the UV screen can be selectably mounted above the shade screen;

the second end of the shade screen having a positioning dowel attached to its end such that the shade screen positioning dowel can be used to adjust the height of the shade screen by moving the shade screen positioning dowel to a different aperture; and the second end of the UV screen having a positioning dowel attached to its end such that the UV screen positioning dowel can be used to adjust the height of the UV screen by moving the UV screen positioning dowel to a different aperture.

2. A multi-screen sunscreen, as in claim 1, further comprising:

height adjustment means in the first support section to permit the attachment of the shade screen or the UV screen to a preselected point on the first support section;

height adjustment means in the second support section to permit the attachment of the shade screen or the UV screen to a preselected point on the second support section; and the preselected height of the shade screen or the UV screen at the first support section is independent of the preselected height of the shade screen or the UV screen at the second support section.

3. A multi-screen sunscreen, as in claim 2, wherein the plane occupied by the shade screen differs from the plane occupied by the UV screen.

4. A multi-screen sunscreen, as in claim 3, wherein:

the first support section further comprising at least one telescoping leg with means to alter the height of the shade screen and/or the UV screen; and the second support section further comprising at least one telescoping leg with means to alter the height of the shade screen and/or the UV screen.

5. A multi-screen sunscreen, as in claim 4, wherein:

the telescoping leg of first support section further comprising a first inner shaft and a first outer sleeve, the first inner shaft and the first outer sleeve further having apertures suitable for accepting a positioning dowel, the position of the first inner shaft slidably adjustable within the first outer sleeve by insertion of the positioning dowel through the aperture in the first inner shaft and the first outer sleeve such that the total height of the first support section is adjustable; and the telescoping leg of second support section further comprising a second inner shaft and a second outer sleeve, the second inner shaft and the second outer sleeve further having apertures suitable for accepting a positioning dowel, the position of the second inner shaft slidably adjustable within the second outer sleeve by insertion of the positioning dowel through the aperture in the second inner shaft and the second outer sleeve such that the total height of the second support section is adjustable.

6. A multi-screen sunscreen, as in claim 4, wherein:

the first support section has at least two telescoping legs, each leg independently height adjustable; and the second support section has at least two telescoping legs, each leg independently height adjustable.

7. A portable multi-screen sunscreen, comprising:

at least one first support section, the first support section having an upper portion for attaching at least one shade screen and one UV screen, and a lower end having means to removably embed the first support section in ground;

at least one second support section, the second support section having an upper portion for attaching at least one shade screen and one UV screen, and a lower end having means to removably embed the second support section in ground;

the first support section further comprising at least one telescoping leg with means to alter the height of the shade screen and/or the UV screen;

the second support section further comprising at least one telescoping leg with means to alter the height of the shade screen and/or the UV screen;

the telescoping leg of first support section further comprising a first inner shaft and a first outer sleeve, the first inner shaft and the first outer sleeve further having apertures suitable for accepting a positioning dowel, the position of the first inner shaft slidably adjustable within the first outer sleeve by insertion of the positioning dowel through the aperture in the first inner shaft and the first outer sleeve such that the total height of the first support section is adjustable;

the telescoping leg of second support section further comprising a second inner shaft and a second outer sleeve, the second inner shaft and the second outer sleeve further having apertures suitable for accepting a positioning dowel, the position of the second inner shaft slidably adjustable within the second outer sleeve by insertion of the positioning dowel through the aperture in the second inner shaft and the second outer sleeve such that the total height of the second support section is adjustable;

a shade screen, the shade screen attached in an open position at a first end to the upper portion of the first support section and attached at a second end to the upper portion of the second support section such that sunlight is substantially blocked by the shade screen when it is in the open position;

a UV screen, the UV screen attached in an open position at a first end to the upper portion of the first support section and attached at a second end to the upper portion of the second support section such that the UV portion of the sunlight is substantially blocked by the UV screen when it is in the open position;

the plane occupied by the shade screen differs from the plane occupied by the UV screen;

the shade screen and the UV screen each having separate attachment means such that the shade screen or the UV screen can be independently detached from at least the first or the second support sections such that they can be retracted from the open to the closed position;

height adjustment means in the first support section to permit the attachment of the shade screen or the UV screen to a preselected point on the first support section;

height adjustment means in the second support section to permit the attachment of the shade screen or the UV screen to a preselected point on the second support section;

the preselected height of the shade screen or the UV screen at the first support section is independent of the preselected height of the shade screen or the UV screen at the second support section;

a shade screen retractor means attached to a first end of the shade screen, the shade screen retractor means having a first spring loaded roller means, the first spring loaded roller means attached to the shade screen such that when the shade screen is released from the open position, the first spring loaded roller means retracts the shade screen to a closed position;

a UV screen retractor means attached to a first end of the UV screen, the UV screen retractor means having a second spring loaded roller means, the second spring loaded roller means attached to the UV screen such that when the UV screen is released from the open position, the second spring means retracts the UV screen to a closed position;

the shade screen retractor means and the UV screen retractor means are enclosed in a single housing assembly, the housing assembly having means to attach to the first or second support sections such that the shade screen can be selectably mounted above the UV screen or the UV screen can be selectably mounted above the shade screen; and the second end of the shade screen having a positioning dowel attached to its end such that the shade screen positioning dowel can be used to adjust the height of the shade screen by moving the shade screen positioning dowel to a different aperture; and the second end of the UV screen having a positioning dowel attached to its end such that the UV screen positioning dowel can be used to adjust the height of the UV screen by moving the UV screen positioning dowel to a different aperture.

8. A portable multi-screen sunscreen, comprising:

at least one first support section, the first support section having an upper portion for attaching at least one shade screen and one UV screen, and a lower end having means to removably embed the first support section in ground;

at least one second support section, the second support section having an upper portion for attaching at least one shade screen and one UV screen, and a lower end having means to removably embed the second support section in ground;

the first support section further comprising at least two telescoping legs, each leg independently height adjustable, with means to alter the height of the shade screen and/or the UV screen;

the second support section further comprising at least two telescoping legs, each leg independently height adjustable, with means to alter the height of the shade screen and/or the UV screen;

a shade screen, the shade screen attached in an open position at a first end to the upper portion of the first support section and attached at a second end to the upper portion of the second support section such that sunlight is substantially blocked by the shade screen when it is in the open position;

a UV screen, the UV screen attached in an open position at a first end to the upper portion of the first support section and attached at a second end to the upper portion of the second support section such that the UV portion of the sunlight is substantially blocked by the UV screen when it is in the open position;

the plane occupied by the shade screen differs from the plane occupied by the UV screen;

the shade screen and the UV screen each having separate attachment means such that the shade screen or the UV screen can be independently detached from at least the first or the second support sections such that they can be retracted from the open to the closed position;

height adjustment means in the first support section to permit the attachment of the shade screen or the UV screen to a preselected point on the first support section;

height adjustment means in the second support section to permit the attachment of the shade screen or the UV screen to a preselected point on the second support section;

the preselected height of the shade screen or the UV screen at the first support section is independent of the preselected height of the shade screen or the UV screen at the second support section;

a shade screen retractor means attached to a first end of the shade screen, the shade screen retractor means having a first spring loaded roller means, the first spring loaded roller means attached to the shade screen such that when the shade screen is released from the open position, the first spring loaded roller means retracts the shade screen to a closed position;

a UV screen retractor means attached to a first end of the UV screen, the UV screen retractor means having a second spring loaded roller means, the second spring loaded roller means attached to the UV screen such that when the UV screen is released from the open position, the second spring means retracts the UV screen to a closed position;

the shade screen retractor means and the UV screen retractor means are enclosed in a single housing assembly, the housing assembly having means to attach to the first or second support sections such that the shade screen can be selectably mounted above the UV screen or the UV screen can be selectably mounted above the shade screen; and the second end of the shade screen having a positioning dowel attached to its end such that the shade screen positioning dowel can be used to adjust the height of the shade screen by moving the shade screen positioning dowel to a different aperture; and the second end of the UV screen having a positioning dowel attached to its end such that the UV screen positioning dowel can be used to adjust the height of the UV screen by moving the UV screen positioning dowel to a different aperture.

9. A multi-screen sunscreen, as in claim 8, wherein:

the first and second support means have coupling means capable of attaching to a second multi-screen sunscreen such that the area shaded or screened from UV can be extended; and the planes of the shade screens and the UV screens on the first multi-screen sunscreen and the shade screens and the UV screens on the second multi-screen sunscreen are independently adjustable.

10. A multi-screen sunscreen, as in claim 9, wherein:

the telescoping leg of first support section further comprising a first inner shaft and a first outer sleeve, the first inner shaft and the first outer sleeve further having apertures suitable for accepting a positioning pin, the position of the first inner shaft slidably adjustable within the first outer sleeve by insertion of the positioning pin through the aperture in the first inner shaft and the first outer sleeve such that the total height of the first support section is adjustable; and the telescoping leg of second support section further comprising a second inner shaft and a second outer sleeve, the second inner shaft and the second outer sleeve further having apertures suitable for accepting a positioning pin, the position of the second inner shaft slidably adjustable within the second outer sleeve by insertion of the positioning pin through the aperture in the second inner shaft and the second outer sleeve such that the total height of the second support section is adjustable.

* * * * *